US012635836B2

(12) United States Patent
Reppy

(10) Patent No.: US 12,635,836 B2
(45) Date of Patent: May 26, 2026

(54) PORTABLE TOILET ASSISTANCE DEVICE

(71) Applicant: Brittany Reppy, Denver, CO (US)

(72) Inventor: Brittany Reppy, Denver, CO (US)

( * ) Notice: Subject to any disclaimer, the term of this patent is extended or adjusted under 35 U.S.C. 154(b) by 0 days.

(21) Appl. No.: 18/100,341

(22) Filed: Jan. 23, 2023

(65) Prior Publication Data

US 2024/0245270 A1 Jul. 25, 2024

(51) Int. Cl.
*A47K 17/02* (2006.01)

(52) U.S. Cl.
CPC ..... *A47K 17/028* (2013.01)

(58) Field of Classification Search
CPC ..... A47K 17/02; A47K 17/028
USPC ..... 4/254, 902
See application file for complete search history.

(56) References Cited

U.S. PATENT DOCUMENTS 6,889,393 B1 5/2005 Rinaldo
2013/0086737 A1 4/2013 Bizar
2015/0272410 A1* 10/2015 Lavassani ..... A47K 17/028 4/254
2016/0309970 A1 10/2016 Collinsworth
2020/0245829 A1 8/2020 Ciordia Sanchez
2022/0369821 A1* 11/2022 Kropfelder ..... A47C 16/02

FOREIGN PATENT DOCUMENTS

WO WO-2017188663 A1 * 11/2017 ..... A47D 1/02

* cited by examiner

*Primary Examiner* — Tuan N Nguyen
(74) *Attorney, Agent, or Firm* — Edison Law Group, PLLC

(57) ABSTRACT

A portable toilet assistance device used in a pair of portable toilet assistance devices, includes a first leg, a second leg, a pivotable hinge connected to the first leg and to the second leg, a first panel, a second panel, a hinge connected to the first leg and to first panel, a hinge connected to the second leg and to second panel, and an inlet positioned on a surface of the first leg and the second leg, the inlet configured to house a fastening device or fastening device mate. Each portable toilet assistance device is unfolded from a collapsed state, placed on the floor and allows the user to sit comfortably on a toilet facility with the user's feet mounted respectively on each portable toilet assistance device.

10 Claims, 5 Drawing Sheets

PORTABLE TOILET ASSISTANCE DEVICE

BACKGROUND

Technical Field

This disclosure relates to toilet assistance devices. In particular, without limitation, the disclosure relates to a portable foldable toilet assistance device.

Toilet assistance devices are known in the art.

U.S. Pat. No. 6,889,393 discloses a combined portable stool and toilet.

US 2013/0086737 discloses a toilet seat stool.

US 2016/0309970 discloses an ultra-portable restroom system.

US 2020/0245829 discloses a toilet bowl with foot support for multi-purpose use.

EP 3 527 730 discloses a toilet with foot resting platform and cistern.

However, the systems known in the art are unwieldy and complicated for portable use in different toilet facilities. Therefore, a need exists for a portable, collapsible toilet assistance device.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

SUMMARY

In an aspect of the disclosure, a portable toilet assistance device used in a pair of portable toilet assistance devices is disclosed, and includes a first leg, a second leg, a pivotable hinge connected to the first leg and to the second leg, a first panel, a second panel where the first panel and the second panel form a third leg when in an un-collapsed state, a hinge connected to the first leg and to first panel, a hinge connected to the second leg and to second panel, and an inlet positioned on a surface of the first leg, of each of the two collapsible stools per foot, and the second leg, the inlet configured to house a fastening device or fastening device mate. Each portable toilet assistance device is unfolded from a collapsed state, placed on the floor and allows the user to sit comfortably on a toilet facility with the user's feet mounted respectively on each individual portable toilet assistance device for each foot.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

A collapsible toilet stool is disclosed, which may take the form of a portable toilet assistance device according to the disclosure. The portable toilet assistance device may assist with a more healthy posture during use of a toilet. The portable toilet assistance device may be portable and readily available for use in restrooms at home or away from home. The portable toilet device may consist of two collapsible triangle-shaped elements, which may be collapsed and held together with a magnet. The resulting shape when collapsed may be rectangular. This shape may allow easy fitting in a person's pocket. The portable toilet assistance device may have rubber footings or rubber linings which may prevent slippage when the portable toilet assistance device is used. When the portable toilet assistance device is un-collapsed, the device may form two triangles for each foot to rest upon, which may aid in relaxed and healthy defecation.

Figure 1:
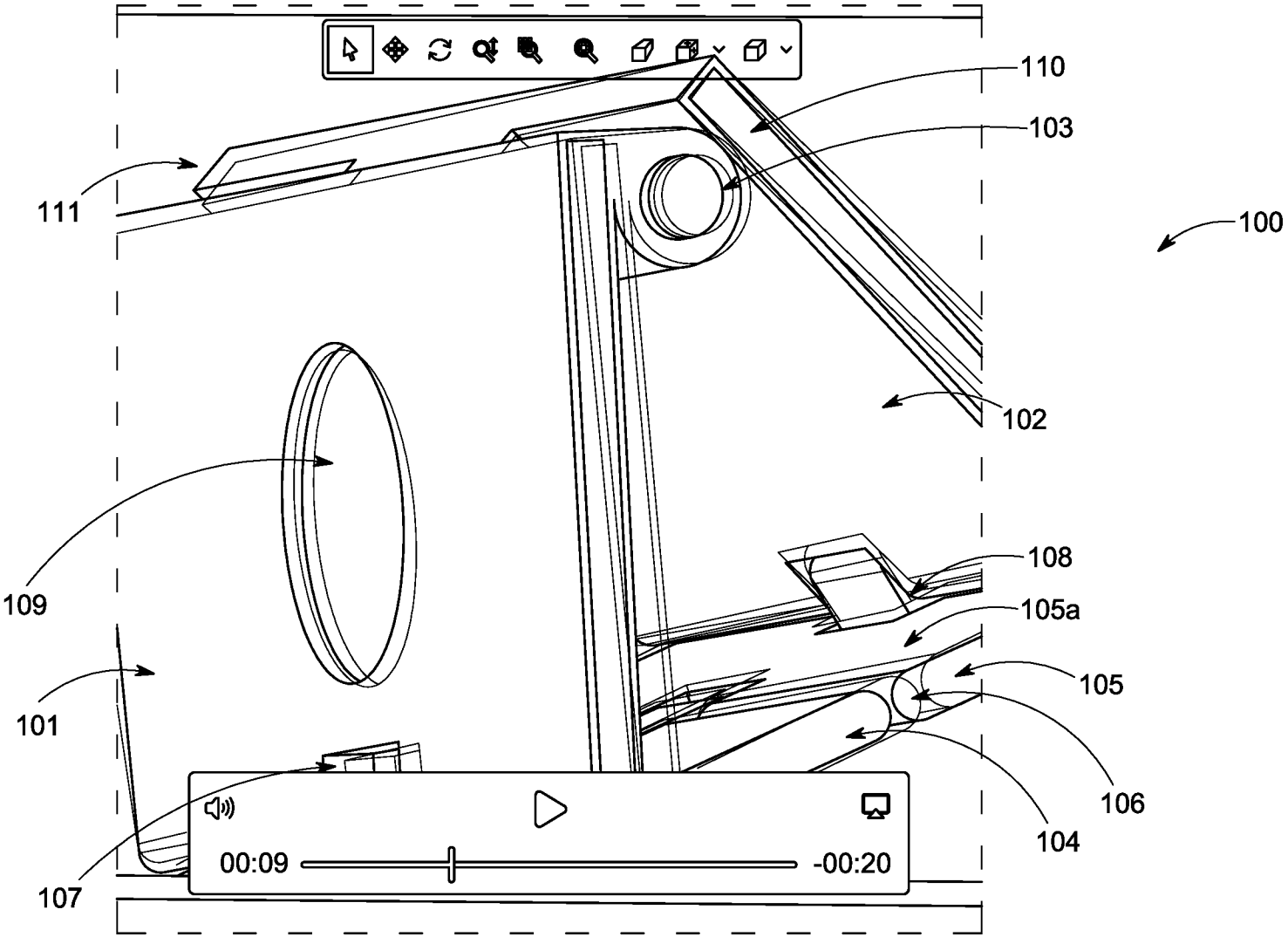
FIG. 1 is a view of a first aspect of a portable toilet assistance device according to the disclosure.

FIG. 1 is view of a first aspect of a portable toilet assistance device 100 according to the disclosure. The portable toilet assistance device 100 illustrated in FIG. 1 is one of two identical devices, both represented by the one portable toilet assistance device 100 duplicated to make up the complete portable toilet assistance device. One foot of a user may be placed on one of the two portable toilet assistance devices 100 and the other foot of the user is placed on the second of two portable toilet assistance devices 100. The portable toilet assistance device 100 may include a first leg 101 and a second leg 102. The first leg 101 and the second leg 102 may be collapsible. The first leg 101 and the second leg 102 may be connected communicatively through a bi-folding hinge 103. A first panel 104 is in communication with a second panel 105 to form a third leg 105*a* that attach with a hinge 106 between them, as well as with a first hinge 107 connecting the first leg 101 with the first panel 104, and a second hinge 108 connecting the second leg 102 with the second panel 105, so that the third leg 105*a* may collapse inward to form a smaller rectangular shape for easy storage/transport.

The portable toilet assistance device 100 may also include a first panel 104 and a second panel 105. The first panel 104 and the second panel 105 may be folded such that they are aligned together to form the third leg 105*a*. The first panel 104 and the second panel 105 make up the third leg 105*a*, forming the triangle rests standing up so a foot can rest on top of the legs 101, 102, and 105*a*. The first panel 104 may pivot around the first hinge 107 within a range of angles, such that the first panel 104 may be positioned directly on a side of the first leg 101 or may be pivoted to form an angle to align with the second panel 105 to form the third leg 105*a*. The second panel 105 is pivotably attached to the second leg 102 with the second hinge 108. The second panel 105 may pivot around the second hinge 108 within a range of angles, such that the second panel 105 may be positioned directly on a side of the second leg 102 or may be pivoted to form an angle to align with the first panel 10.

In an aspect of the disclosure, an inlet 109 may be positioned on the first leg 101 and the second leg 102. The inlet 109 may include a magnet to fasten to the metal inlet 108 at the same spot for the second identical and collapsible portable toilet assistance device 100 for the second foot. A magnet or fastening material or other securing mechanism in the inlet 109 may facilitate keeping the first leg 101 on the first of two portable toilet assistance devices 100 to the same respective leg/inlet 109 on the second portable toilet assistance device 100, so that it is securely retained for convenient storage and transport. The portable toilet assistance device 100 may also be configured such that a user may place a foot upon the top of the first leg 101, the second leg 102 and the third leg 105*a* where rubber strips may be affixed to a top surface 110 and a bottom surface 111 (not visible) of the first leg 101, the second leg 102 and the third leg 105*a* to prevent the feet or device from slipping.

Figure 2:
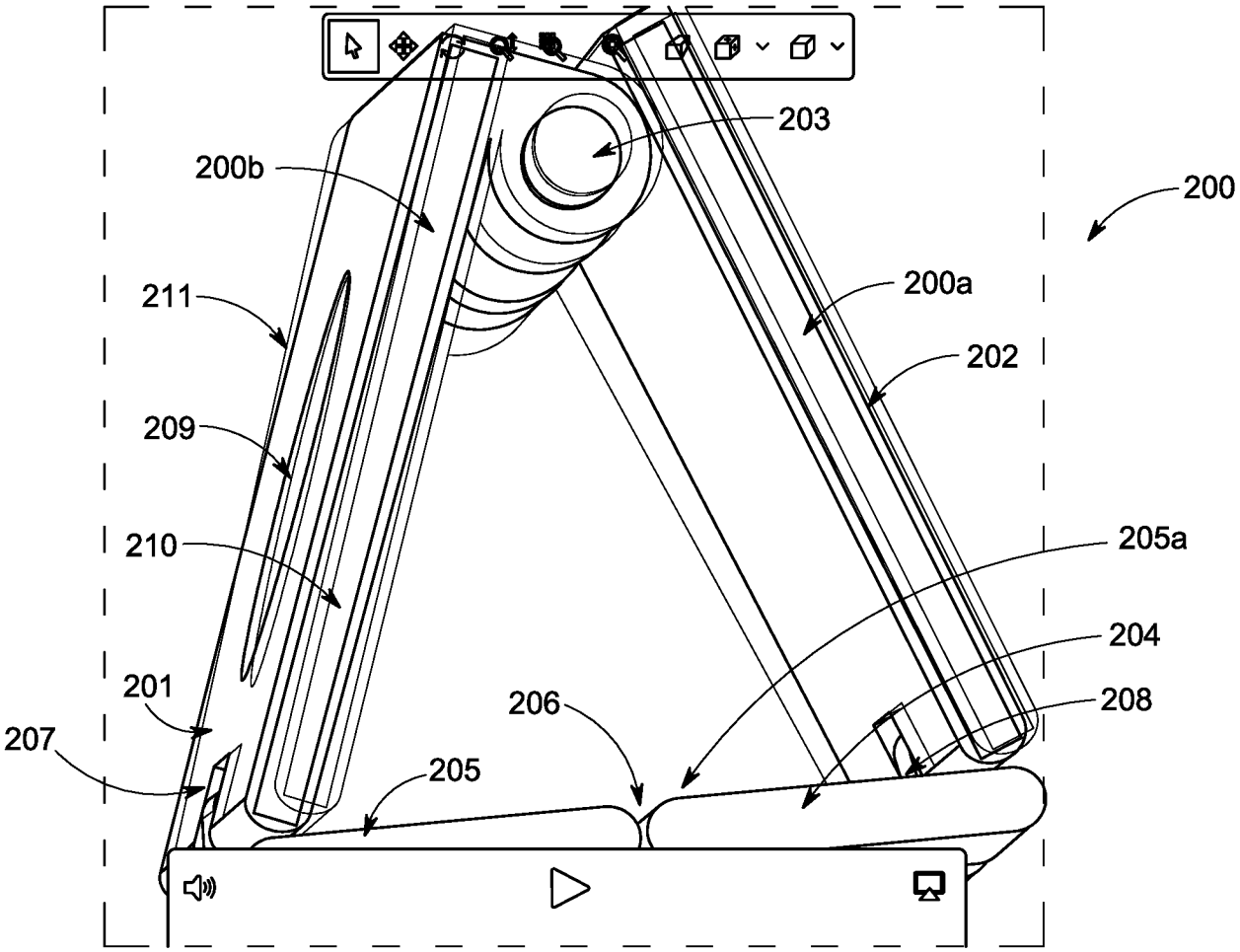
FIG. 2 a view of a second aspect of a portable toilet assistance device according to the disclosure.

FIG. 2 a view of a second aspect of a portable toilet assistance device 200 according to the disclosure. As with FIG. 1, the portable toilet assistance device 200 consists of two identical portable toilet assistance devices used together. FIG. 2 represents a bird's eye view of a top surface 200*a* and 200*b* of one of the two portable toilet assistance devices 200. The first of two separate portable toilet assistance devices (one for each foot) 200 may include a first panel 201 and a second panel 202 and a third collapsible leg 205*a* comprised of the first panel 204 and the second panel 205. The first leg 201 and the second leg 202 may be connected communicatively through a bi-folding hinge 203. The first leg 201 and the second leg 202 may pivot about the bi-folding hinge 203 to form a triangle shape or collapsed device on the first panel 204 and the second panel 205 to form a smaller/portable rectangle shape. In another aspect of the disclosure, the first leg 201 and the second leg 202 may pivot around the bi-folding hinge 203 to close against each other to fit into a smaller space, such as a user's pocket or carrying bag.

The portable toilet assistance device 200 may also include a first panel 204 and a second panel 205. The first panel 204 and the second panel 205 may be folded such that they are aligned together to form the third leg 205*a*. The first panel 204 and the second panel 205 make up the third leg 205*a*, forming the triangle that rests standing up so a foot can rest on top of the legs 201, 202, and 205*a*. The first panel 204 may pivot around the first hinge 207 within a range of angles, such that the first panel 204 may be positioned directly on a side of the first leg 201 or may be pivoted to form an angle to align with the second panel 205 to form the third leg 205*a*, via a third hinge 206. The second panel 205 is pivotably attached to the second leg 202 with the second hinge 208. The second panel 205 may pivot around the second hinge 208 within a range of angles, such that the second panel 205 may be positioned directly on a side of the second leg 202 or may be pivoted to form an angle to align with the first panel 201, via the third hinge 206.

In an aspect of the disclosure, an inlet 209 may be positioned on the first leg 201 and the second leg 202. The inlet 209 may include a magnet to fasten to the metal inlet 208 at the same spot for the second identical and collapsible portable toilet assistance device 200 for the second foot. A magnet or other securing mechanism in the inlet 209 may facilitate keeping the first leg 201 on the first of two portable toilet assistance devices 200 to the same respective leg/inlet 209 on the second portable toilet assistance device 200, so that it is securely retained for convenient storage and transport. The portable toilet assistance device 200 may also be configured such that a user may place a foot upon the top of the first leg 201, the second leg 202 and the third leg 205*a* where rubber strips may be affixed to a top surface 210 and a bottom surface 211 (not visible) of the first leg 201, the second leg 202 and the third leg 205*a* to prevent the feet or device from slipping.

Figure 3:
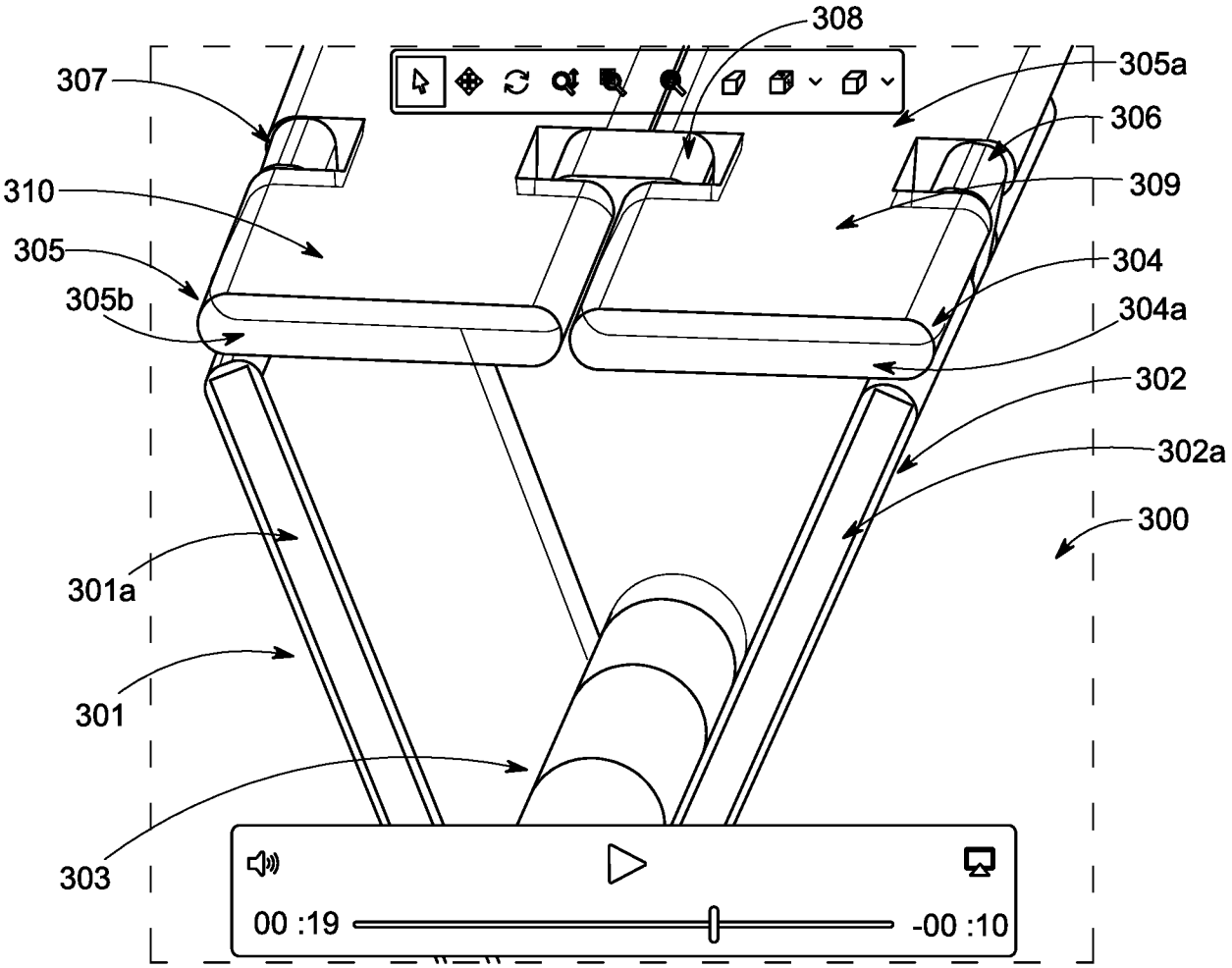
FIG. 3 a view of a third aspect of a portable toilet assistance device according to the disclosure.

FIG. 3 a view of a third aspect of a portable toilet assistance device 300 according to the disclosure. As with FIGS. 1-2, the portable toilet assistance device 300 consists of two identical portable toilet assistance devices used together. FIG. 3 is a view of the bottom side of the portable assistance device 300, either the first or second of two portable toilet assistance devices 300 used together. The portable toilet assistance device 300 may include a first leg 301 and a second leg 302. The first leg 301 and the second leg 302 may be collapsible. The first leg 301 and the second leg 302 may be connected communicatively through a bi-folding hinge 303. The first leg 301 and the second leg 302 may pivot about the bi-folding hinge 303 to form a triangle shape. In another aspect of the disclosure, the first leg 301 and the second leg 302 may pivot around the bi-folding hinge 303 to close against each other to fit into a smaller space, such as a user's pocket or carrying bag.

The portable toilet assistance device 300 may also include a first panel 304 and a second panel 305. The first panel 304 and the second panel 305 may be folded such that they are aligned together to form a base structure upon which the portable toilet assistance device 300 may rest. The first panel 304 and the second panel 305 may be folded such that they are aligned together to form the third leg 305*a*. The first panel 304 and the second panel 305 make up the third leg 305*a*, forming the triangle that rests standing up so a foot can rest on top of the legs 301, 302, and 305*a*. The first panel 304 may pivot around the first hinge 306 within a range of angles, such that the first panel 304 may be positioned directly on a side of the first leg 301 or may be pivoted to form an angle to align with the second panel 305 to form the third leg 305*a*, via a third hinge 308. The second panel 305 is pivotably attached to the second leg 302 with the second hinge 307. The second panel 305 may pivot around the second hinge 308 within a range of angles, such that the second panel 305 may be positioned directly on a side of the second leg 302 or may be pivoted to form an angle to align with the first panel 301, via the third hinge 308. The first panel 304 is pivotably attached to the first leg 301 with a first hinge 306. The first panel 304 may pivot around the first hinge 306 within a range of angles, such that the first leg 304 may be positioned directly on a side of the first leg 301 or may be pivoted to form an angle to match up with the second panel 304. The second leg 305 is pivotably attached to the second leg 302 with a second hinge 307. The second panel 305 may pivot around the first hinge 307 within a range of angles, such that the first panel 304 may be positioned directly on a side of the first leg 301 or may be pivoted via the third hinge 308 to form an angle to match up with the second panel 304. An outer surface of the first leg 301*a*, an outer surface of the second leg 302*a*, an outer surface of the first leg base 304*b* and an outer surface of the second panel 305*a*, and the opposing sides of the portable toilet assistance device 300 (not shown in this perspective) may be coated with a non-slip material. The non-slip material may be a rubber material, a non-slip grip tape or other non-slip and non-skid materials known in the art. The non-slip material may serve to anchor the portable toilet assistance device 300 and may prevent it from moving when placed down The portable toilet assistance device 300 may form a triangle that is positioned lengthwise so that the formed triangle is placed on the ground and the feet go on the opposite end of the triangle. Two portable toilet assistance devices 300 may be employed to form two upright triangles that will be placed under each foot and has a specific foot mount for each foot. The portable toilet assistance device 300 may be folded inward via the third hinge 308 to make an individual portable toilet assistance device 300 fold into a smaller rectangular shape, which may then connect to the second portable toilet assistance device 300 of the pair, via a magnetically attracted fastener positioned within inlets disposed on both of the portable toilet assistance devices 300 (inlets not shown here).

Figure 4:
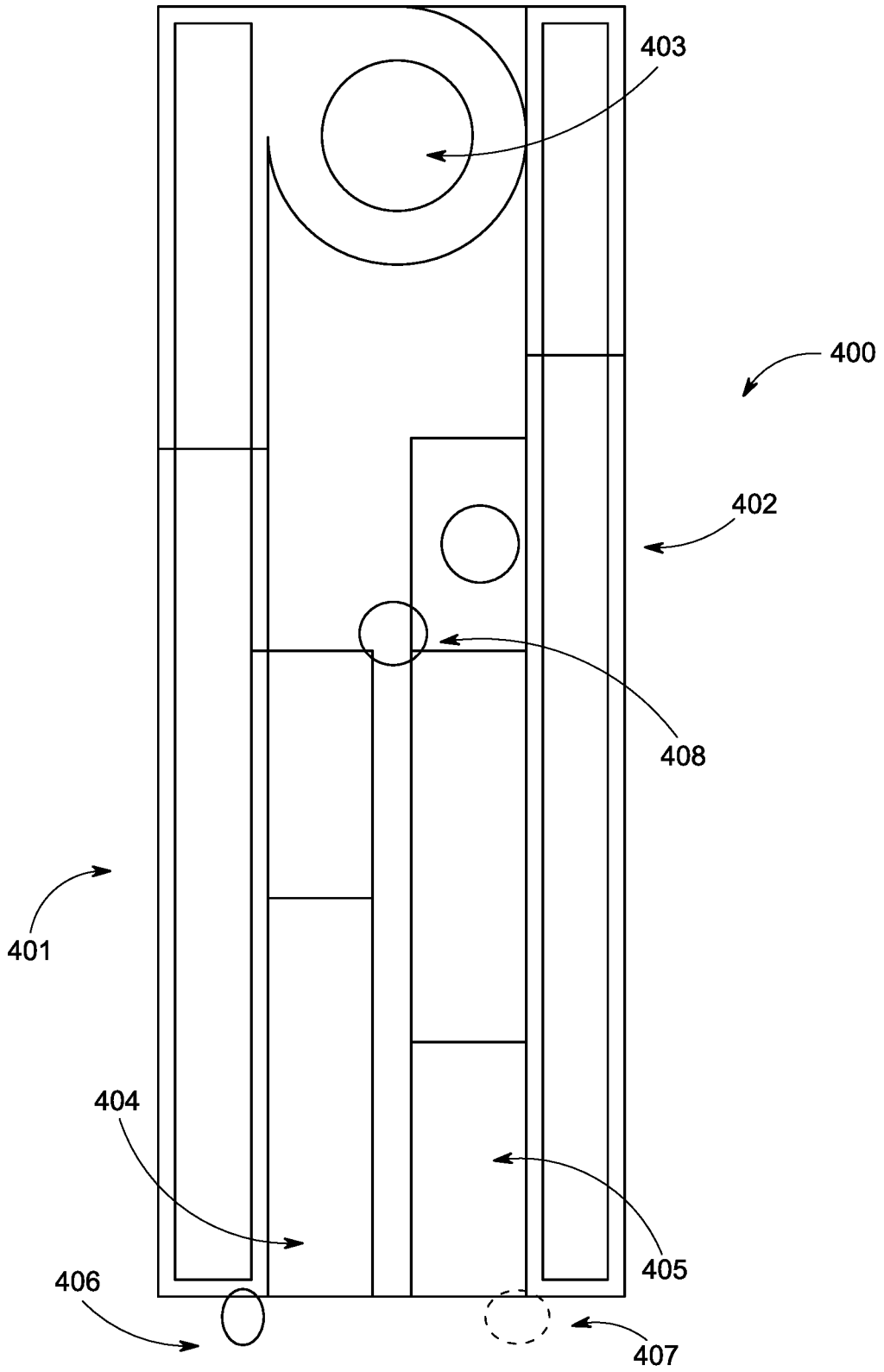
FIG. 4 a view of a fourth aspect of a portable toilet assistance device according to the disclosure.

FIG. 4 a view of a fourth aspect of a portable toilet assistance device according to the disclosure. FIG. 4 is an aerial view one of each of the two collapsing portable toilet assistance devices 400 per foot (only one portable toilet assistance device shown in illustrations) when collapsed. The portable toilet assistance device 400 may include a first leg 401 and a second leg 402.

The portable toilet assistance device 400 may also include a first panel 404 and a second panel 405. In an aspect, the first panel 404 and the second panel 405 may be folded inward as shown in FIG. 4, such that the first panel 404 aligns with and rests against first leg 401, via the first hinge 406 and the second panel 405 aligns with and rests against second leg 402, via the second hinge 407. The first panel 304 and the second panel 305 may be folded outward from the positions shown in FIG. 4 such that they are aligned together to form the third leg 305*a*.

The first leg 401 and the second leg 402 may pivot about the bi-folding hinge 403 to allow first panel 404 and second panel 405 to collapse inwardly. The first panel 404 pivots via third hinge 408 along with the second panel 405 to form a third leg, as illustrated in FIGS. 1-3 105*a*, 205*a* and 305*a*. In another aspect of the disclosure, the first leg 401 and the second leg 402 may pivot around the bi-folding hinge 403 to close against each other to fit into a smaller space, such as a user's pocket or carrying bag.

Figure 5:
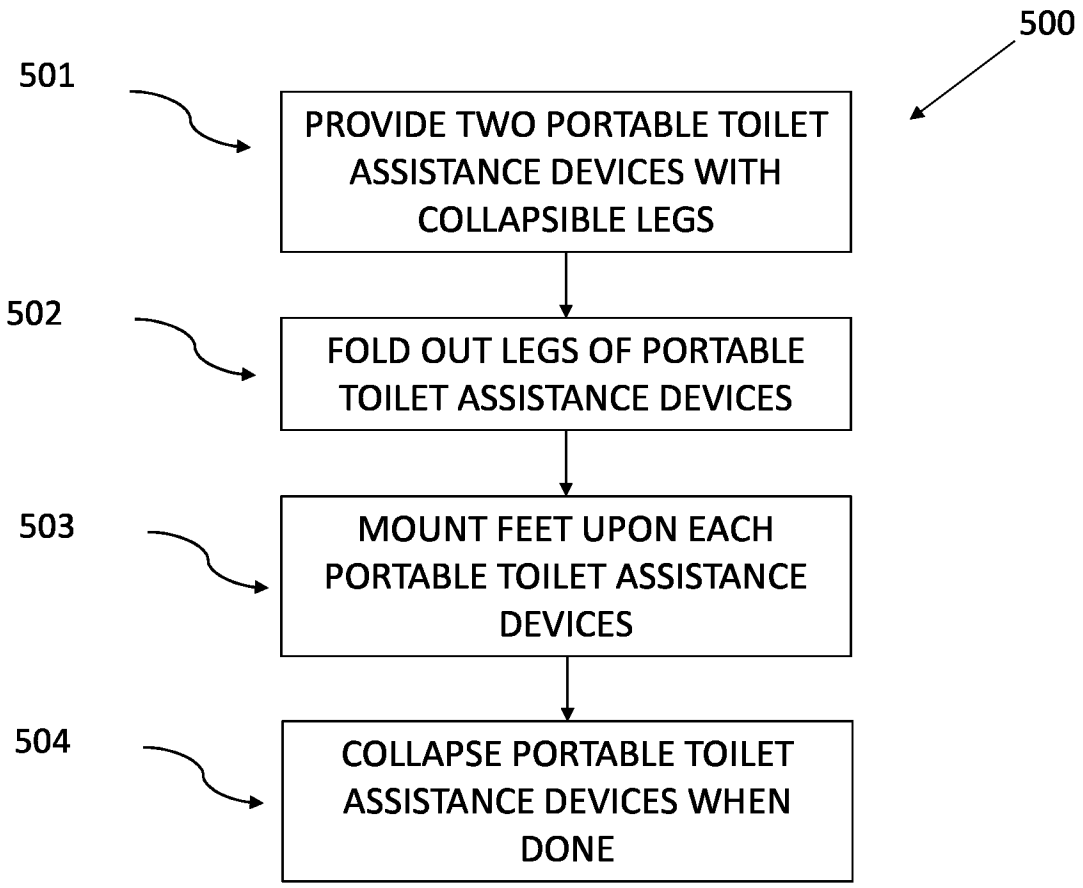
FIG. 5 is a flowchart showing acts taken in a method to use a portable toilet assistance device, according to the disclosure.

FIG. 5 is a flowchart illustrating a method for using a portable toilet assistance device 500 according to the disclosure. In one aspect of the method, two portable toilet assistance devices, each with a foot mount device is provided, each comprising two collapsible legs and a collapsible base made up of two panels hinged by a pivotable hinge positioned between the two panels as shown in FIGS. 1-3.

In act 501, the two portable toilet assistance devices are provided to the user in collapsed configurations (as illustrated in FIG. 4), with the base panels folded inwardly to rest against respective legs. The two portable toilet assistance devices may have top and bottom surfaces lined with a non-slip material, such as rubber, grip tape or other non-slip materials known to one of skill in the art.

In act 502 in an aspect of the method, the two portable toilet assistance devices are unfolded to form a triangle shape as illustrated in FIGS. 1-3. when the two base panels of an individual portable toilet assistance device are folded outward via the hinge between the two panels and placed on a floor and secured with rubber linings on the surfaces of the portable assistance devices.

In act 503, a user may mount his or her feet upon the portable toilet assistance devices during use of toilet facilities. The user may place his or her feet each un-collapsed portable toilet assistance device, resting the feet on the standing triangle shape formed by the un-collapsed portable toilet assistances, heel at base and toes towards the apex, for comfortable use of toilet facilities.

In act 504, once the visit to the toilet facilities is completed, the user may then collapse each portable toilet assistance device and collapse the base panels via the hinge between the base panels. The collapsed portable toilet assistance devices may then be attached to each other via a magnetically attracted faster or other fastening mechanism for easy storage and transport.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A portable toilet assistance device for resting feet of a user when sitting in a toilet facility, comprising:

a first leg;

a second leg;

a pivotable hinge communicatively connected to the first leg and to the second leg;

a first panel;

a second panel;

a first hinge communicatively connected to the first leg and to the first panel;

a second hinge communicatively connected to the second leg and to second panel; and a first inlet positioned on a surface of the first leg and a second inlet positioned on a surface of the second leg, either of the first inlet or the second inlet configured to house a fastening device configured to couple the portable toilet assistance device with a second portable assistance device, where the first panel and the second panel are coupled by a pivotable hinge positioned between the first panel and the second panel, such that the first panel and second panel form a third leg when the first panel and the second panel are unfolded from a collapsed state where the first panel is aligned with the first leg and the second panel is aligned with the second leg to an un-collapsed state.

2. The portable toilet assistance device of claim 1, where the fastening device comprises a magnet.

3. The portable toilet assistance device of claim 1, further comprising a non-slip material disposed upon a surface of the first leg and a surface of the second leg, where the non-slip material prevents movement of the portable toilet assistance device when set on a floor.

4. The portable toilet assistance device of claim 3, where the non-slip material is a rubber material.

5. The portable toilet assistance device of claim 1, where the first panel and the second panel are configured to fold up inwardly via the hinge against the first leg and the second leg respectively.

6. The portable toilet assistance device of claim 1, where the portable toilet assistance device is configured to allow a user to place one foot upon the surface of the first leg and the surface of the second leg of the portable toilet assistance device and a second foot upon a surface of a first leg and a surface of a second leg of the second portable toilet assistance device.

7. The portable toilet assistance device of claim 1, where the portable toilet assistance device is configured to form a triangle shape when in the un-collapsed state.

8. The portable toilet assistance device of claim 1, where the portable toilet assistance device is configured to fit within a pocket of a user's clothing.

9. A method of using a portable toilet assistance device, the method comprising:

providing at least two portable toilet assistance devices comprising at least two collapsible legs and a collapsible base, the portable toilet assistance device configured as a triangle shape when placed on a floor in an un-collapsed state;

unfolding the at least two portable toilet assistance devices by pivoting the at least two collapsible legs and the collapsible base;

mounting, by a user, feet upon the at least two portable toilet assistance devices during use of toilet facilities; and collapsing the at least two collapsible legs and the collapsible base of the at least two portable toilet assistance devices when the user is finished using the toilet facilities.

10. The method of claim 9, where providing the foot mount device comprises providing non-slip material on the base of the least two portable toilet assistance devices.

* * * * *